US006379879B2

(12) United States Patent
Hagemann et al.

(10) Patent No.: US 6,379,879 B2
(45) Date of Patent: Apr. 30, 2002

(54) COLOR PHOTOGRAPHIC SILVER HALIDE MATERIAL

(75) Inventors: Jörg Hagemann, Köln; Günter Helling, Odenthal; Heinz Wiesen, Euskirchen; Ralf Wirowski, Köln; Ralf Büscher, Lohmar, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/793,045

(22) Filed: Feb. 26, 2001

(30) Foreign Application Priority Data

Feb. 29, 2000 (DE) ..... 100 09 566

(51) Int. Cl.[7] ..... G63C 1/08; G03C 7/26; G03C 7/32

(52) U.S. Cl. ..... 430/544; 430/631; 430/635; 430/636; 430/505; 430/955; 430/957; 430/552; 430/553; 430/554; 430/555; 430/557

(58) Field of Search ..... 430/546, 631, 430/635, 636, 544, 505, 955, 957, 557, 554, 555, 552, 553

(56) References Cited

U.S. PATENT DOCUMENTS 4,184,876 A 1/1980 Eelas et al. ..... 430/505
5,484,692 A * 1/1996 Mitsui et al. ..... 430/546
6,120,981 A * 9/2000 Hoke et al. ..... 430/546
6,200,741 B1 * 3/2001 Stanley et al. ..... 430/546

FOREIGN PATENT DOCUMENTS

| | | |
|---|---|---|
| DE | 25 30 645 | 1/1976 |
| DE | 39 36 300 | 5/1991 |
| DE | 195 43 203 | 5/1997 |
| EP | 536 889 | 4/1993 |

* cited by examiner

*Primary Examiner*—Geraldine Letscher
(74) *Attorney, Agent, or Firm*—Connoly Bove Lodge & Hutz LLP

(57) ABSTRACT

A color photographic recording material having at least one spectrally sensitized silver halide emulsion layer, characterized in that said silver halide emulsion layer contains an oil former having a pKa value of less than 18 and a DIR coupler and the material contains at least one color coupler, wherein the color coupler and/or the DIR coupler have specific structures, is distinguished by an increased interimage effect in comparison with the prior art without sensitivity being reduced.

10 Claims, No Drawings

COLOR PHOTOGRAPHIC SILVER HALIDE MATERIAL

This invention relates to a colour photographic material having at least one spectrally sensitised silver halide emulsion layer, which contains an oil former, together with a coupler which releases a development inhibitor on colour development.

It is known t o perform chromogenic development in the presence of compounds which, on development, release diffusible substances in accordance with the image, which substances perform a certain action, for example are capable of influencing silver halide development. In the event that said action comprises inhibition of further development, such compounds are known as DIR (=Development Inhibitor Releasing) compounds. DIR compounds may comprise those which react with a colour developer oxidation product with elimination of an inhibitor residue to yield a dye (DIR couplers) or those which release the inhibitor without simultaneously forming a dye. The latter are also strictly speaking known as DIR compounds.

DIR couplers are frequently introduced into photographic layers as emulsions. Emulsions are finely divided dispersions of oil in an aqueous medium, wherein the oil droplets then consist of a solution of DIR couplers in a high-boiling solvent, the "oil former". Conventional oil formers, such as for example tricresyl phosphate, which is very frequently used, are hydrophobic. EP 536 889 does, however, also disclose the use of DIR couplers together with special protic oil formers in green-sensitive silver halide emulsion layers containing pyrazoloazole magenta couplers. According to said application, the special oil formers make it possible to offset the disadvantages of pyrazoloazole magenta couplers, such as poor processing stability.

DIR couplers give rise to a desired increase in the interimage effect in colour photographic materials. DIR couplers may also improve sharpness and grain. However, as a result of development inhibition, the use of DIR couplers also results in an unwanted reduction in sensitivity.

The object underlying the invention is to provide a colour photographic material which contains at least one DIR coupler together with at least one oil former and in which the interimage effect is increased in comparison with the prior art, but in which the use of the DIR coupler brings about no reduction in sensitivity in comparison with the prior art.

The present invention provides a colour photographic recording material having at least one spectrally sensitised silver halide emulsion layer, characterised in that said silver halide emulsion layer contains an oil former having a pKa value of less than 18 and a DIR coupler and the material contains at least one colour coupler which complies with the formulae (K-I)

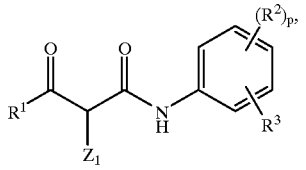

-continued (K-II)

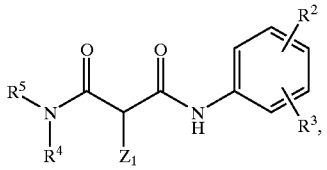

(K-III)

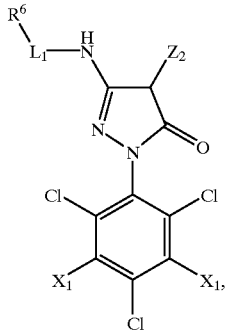

(K-IV)

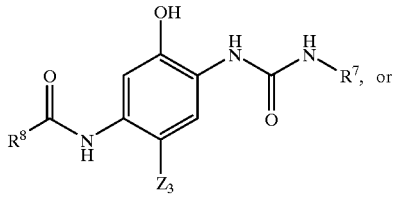

(K-V)

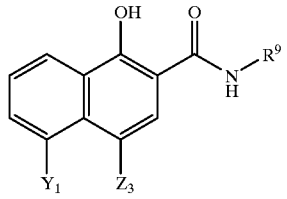

in which $R^1$, $R^6$, $R^9$ mean alkyl aryl;

$R^2$ means chlorine, alkoxy;

$R^3$ means acyl, acylamino;

$R^4$, $R^5$, $R^8$ mean alkyl;

$R^7$ means aryl;

$L_1$ means a single bond, —CO—;

$Y_1$, means hydrogen, carbamoyloxy;

$X_1$ means hydrogen, chlorine;

$Z_1$ means a heterocyclic, nitrogenous, N-linked 5-membered ring;

$Z_2$ means hydrogen, alkylsulfido, arylsulfido or a heteroaromatic, nitrogenous, N-linked, 5-membered ring;

$Z_3$ means hydrogen, chlorine, alkoxy, aryloxy, alkylsulfido and p means 1 or 2, and wherein $R^4$ and $R^5$ may form a 5- or 6-membered ring.

The $pK_3$ values of the oil formers are determined by titration with tetrabutyl-ammonium hydroxide (TBAH) in dimethyl sulfoxide/water (100:0.25), as described in "Acid Base Titrations in Nonaqueous Solvents", Allyn and Bacon Inc., Boston 1973 and in W. Huber "Titration in nichtwässrigen Lösungsmitteln", Akademische Verlagsgesellschaft, Frankfurt am Main 1964.

It has surprisingly been found that an increased interimage effect is achieved with the embodiment of the photographic material according to the invention, without any reduction in sensitivity.

Compounds (K-1) to (K-20) are examples of suitable couplers of the formulae (K-I), (K-II), (K-III), (K-IV) and (K-V).

K-1

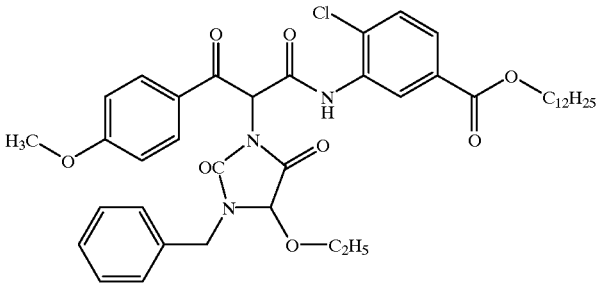

K-2

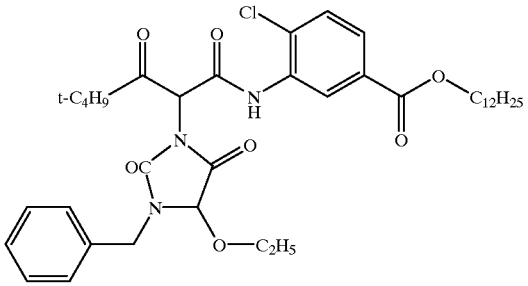

K-3

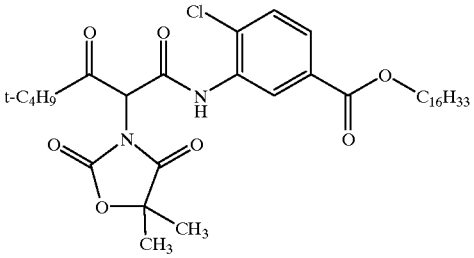

K-4

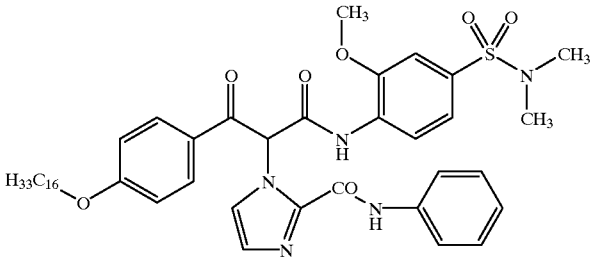

K-5

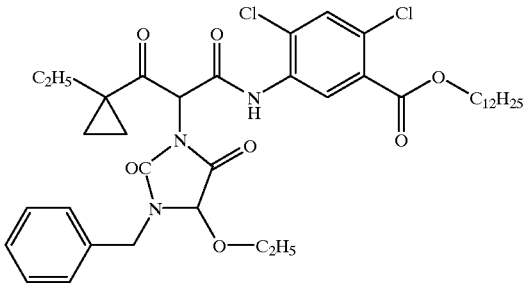

K-6

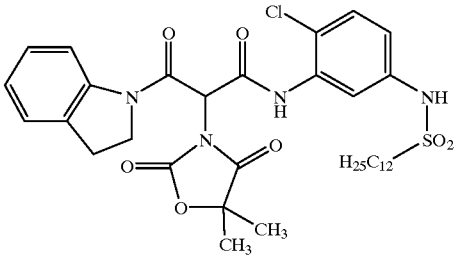

-continued
K-7
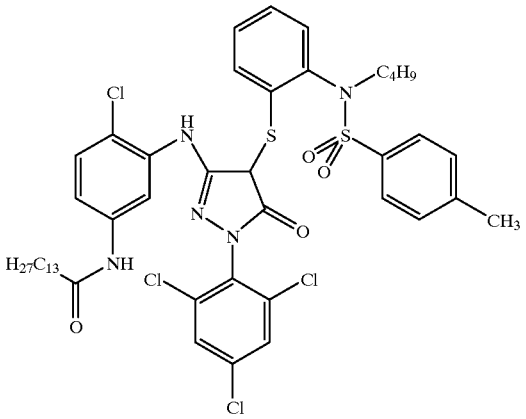
K-8
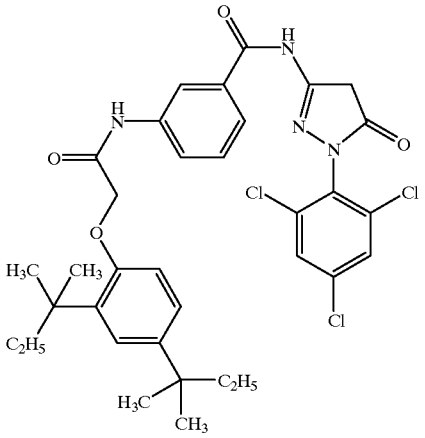
K-9
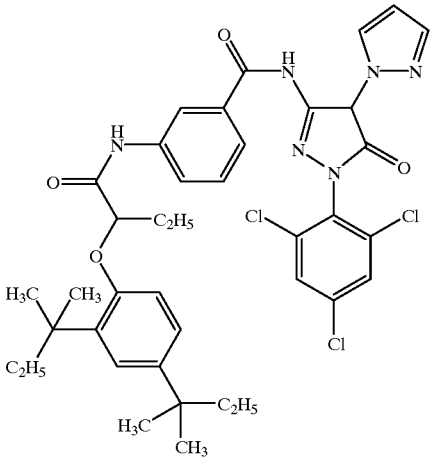
K-10
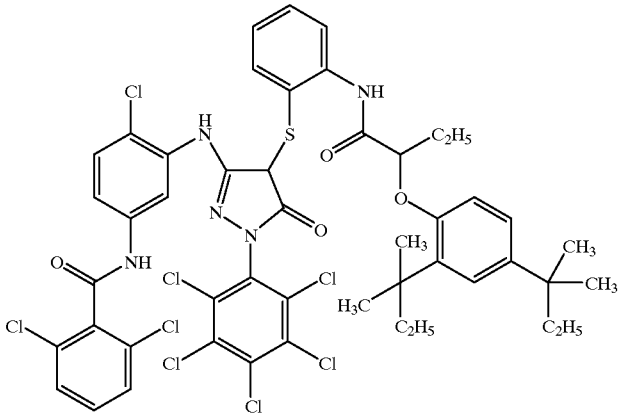

-continued
K-11
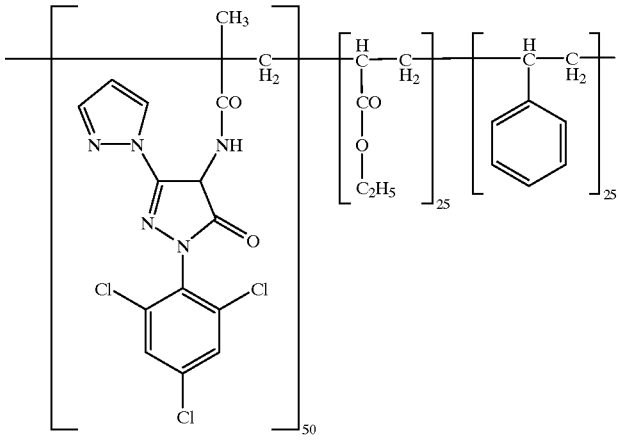
K-12
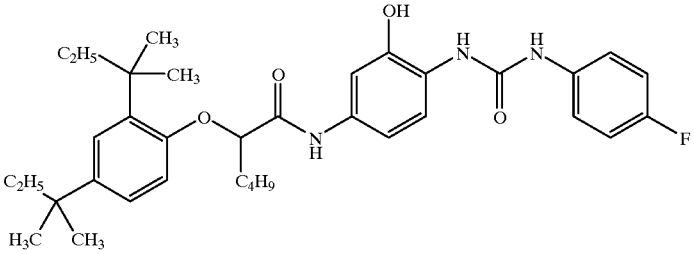
K-13
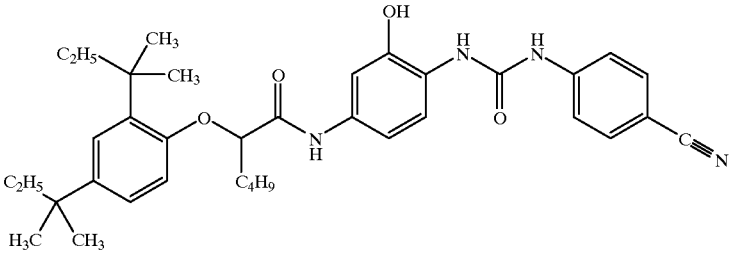
K-14
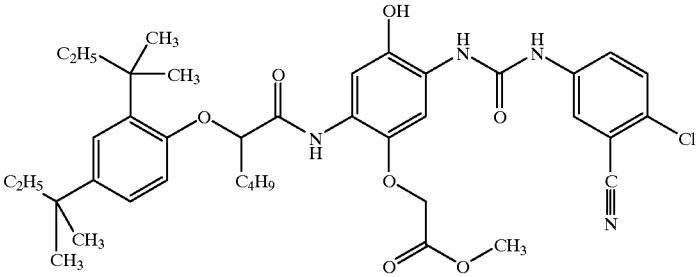
K-15
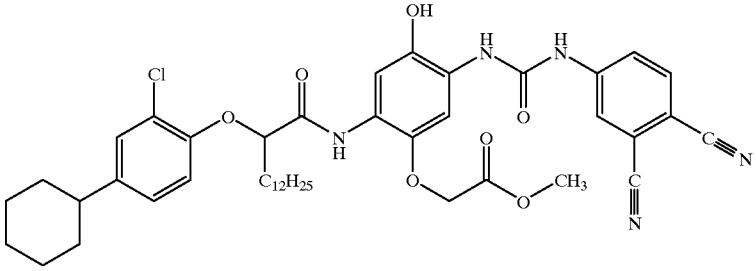

-continued
K-16
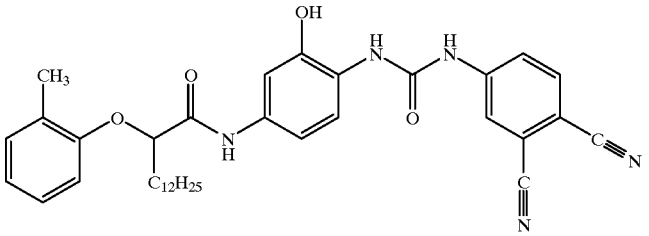
K-17
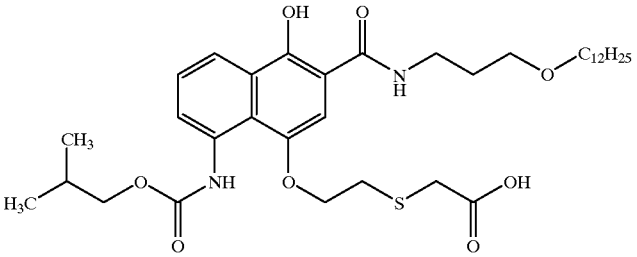
K-18
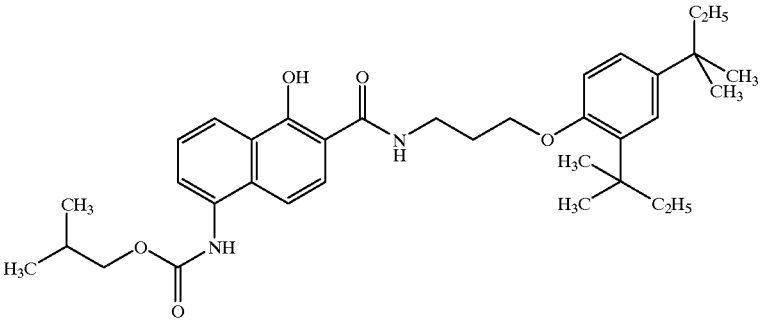
K-19
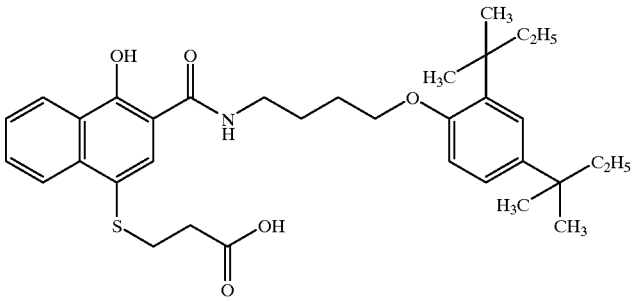
K-20
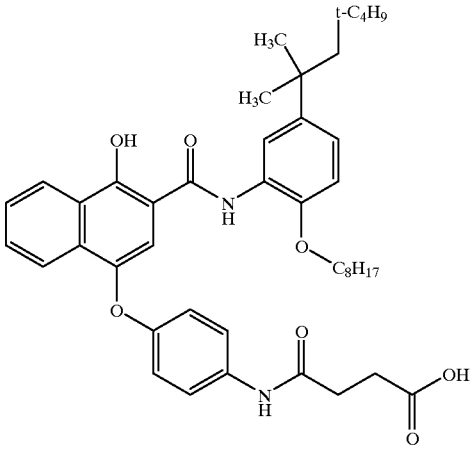

Particularly preferred colour couplers are of the formula (K-III).

Suitable DIR couplers for the purposes of the present invention may be found in Research Disclosure 37254, part 5 (1995), page 290, in Research Disclosure 37038, part XIV (1995), page 86 and in Research Disclosure 38957, part X c (1996), page 618.

In a preferred embodiment, the DIR coupler complies with the formula (D-I), (D-I)

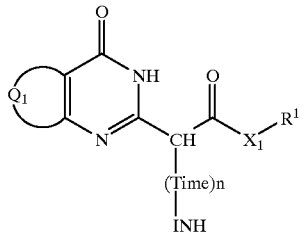

wherein $Q_1$ means the remaining members to complete a fused and optionally substituted benzene or heteroaromatic ring;

$X_1$ means O or $NR^2$;

$R^1$ means alkyl, aryl, hetaryl or alkenyl;

$R^2$ means H or $R^1$;

INH means

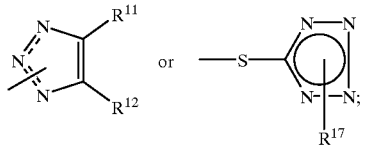

Time means a linking member which, on reaction of the coupler with the oxidation product of a silver halide developer, is released together with the residue INH attached thereto and in turn releases the residue INH with a delay under development conditions;

$R^{11}$, $R^{12}$ mean H, alkyl, aryl, alkaryl, —S—$R^{13}$, —COO—$R^{13}$, —CON($R^{13}$)$R^{14}$, —N($R^{15}$)$R^{16}$, —O$R^{13}$, or a heterocyclic group;

$R^{13}$, $R^{14}$ mean alkyl, aryl, alkenyl or alkynyl;

$R^{15}$ means H or $R^{13}$;

$R^{16}$ means acyl or $R^{13}$;

$R^{17}$ means H, alkyl, aryl or a heterocyclic group and n means 0 or 1, wherein at least one of the residues $R^{11}$ or $R^{12}$ is not H and $R^{11}$ and $R^{12}$, $R^{13}$ and $R^{14}$ or $R^{15}$ and $R^{16}$ may form a five- to seven-membered ring.

Particularly preferred compounds (D-I) are those in which INH denotes

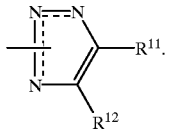

The present invention also provides a colour photographic recording material having at least one spectrally sensitised silver halide emulsion layer, characterised in that said silver halide emulsion layer contains an oil former having a pKa value of less than 18 and a DIR coupler which is of the formula $$A^1\text{-}(\text{Time})_n\text{-INH} \qquad \text{(D-II)}$$

wherein $A^1$ is of the formula (D-III)

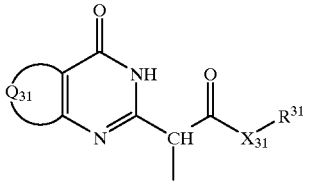

or corresponds to the residue of a malonic acid diester, malonic acid diamide or malonic ester amide yellow coupler, of an acylacetamide or -anilide yellow coupler, of an anilino- and acylaminopyrazolone magenta coupler, of a pyrrolotriazole or pyrrolobenzimidazole magenta coupler, of a 2-acylamino-, 2,5-diacylamino- or 2-ureido-5-acylaminophenol cyano coupler or of a 2-acyl- or 2-acyl-5-acylaminonaphthol cyan coupler, which couples with the oxidation product of a silver halide developer under the conditions of photographic development and so releases the residue of the formula $$\text{-}(\text{Time})_n\text{-INH;}$$

INH means

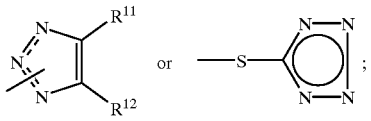

Time means a linking member which, on reaction of the coupler with the oxidation product of a silver halide developer, is released together with the residue INH attached thereto and in turn releases the residue INH with a delay under development conditions;

$R^{11}$, $R^{12}$ mean H, alkyl, aryl, alkaryl, —S—$R^{13}$, —COO—$R^{13}$, —CON($R^{13}$)$R^{14}$, —N($R^{15}$)$R^{16}$, —O$R^{13}$, or a heterocyclic group;

$R^{13}$, $R^{14}$ mean alkyl, aryl, alkenyl or alkynyl;

$R^{15}$ means H or $R^{13}$;

$R^{16}$ means acyl or $R^{13}$;

$R^{17}$ means H, alkyl, aryl or a heterocyclic group;

n means 0 or 1;

$Q_{31}$ means the remaining members to complete a fused and optionally substituted benzene or heteroaromatic ring;

$X_{31}$ means O or $NR^{32}$;

$R^{31}$ means alkyl, aryl, hetaryl or alkenyl and $R^{32}$ means H or $R^{31}$, and wherein at least one of the residues $R^{11}$ or $R^{12}$ is not H and $R^{11}$ and $R^{12}$, $R^{13}$ and $R^{14}$ or $R^{15}$ and $R^{16}$ may form a five- to seven-membered ring.

In a preferred embodiment, the compounds are of the formula (D-II), in which $R^{11}$ and $R^{12}$ denote H, alkyl, aryl, —$SR^{13}$, —COO—$R^{13}$, —COON($R^{13}$)$R^{14}$ or —O—$R^{13}$ and $R^{13}$, $R^{14}$ denote alkyl, aryl or alkynyl.

Particularly preferably, the compounds are of the formula (D-II), in which INH denotes

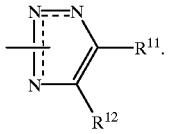

In another preferred embodiment, the coupler residue $A^1$ denotes a residue of the formula (D-III) or the residue of a benzoylacetanilide yellow coupler, of an anilino- or acylaminopyrazolone magenta coupler, of a pyrrolotriazole or pyrrolobenzimidazole magenta coupler, of a 2-acylamino-, 2,5-diacylamino- or 2-ureido-5-acylaminophenol cyan coupler, or of a 2-acyl-5-acylaminonaphthol cyan coupler.

It has surprisingly been found that an increased interimage effect is also achieved with this embodiment of the photographic material according to the invention, without any reduction in sensitivity.

Examples of DIR couplers of the formulae (D-I) or (D-II), which are suitable for the material according to the invention are the compounds (D-1) to (D-23).

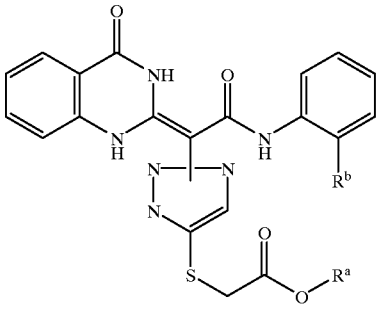

D-1

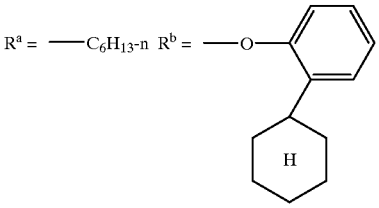

D-2

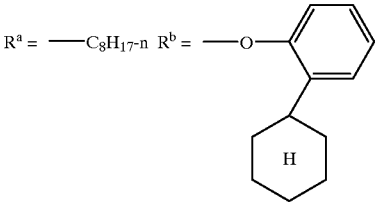

D-3

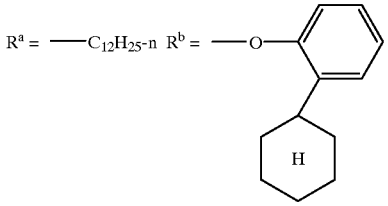

D-4

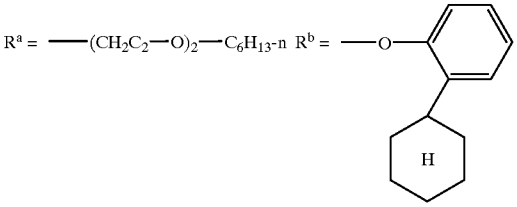

D-5

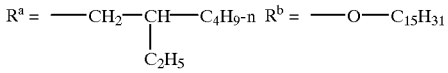

D-6

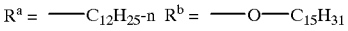

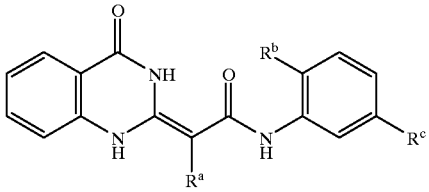

-continued
D-7
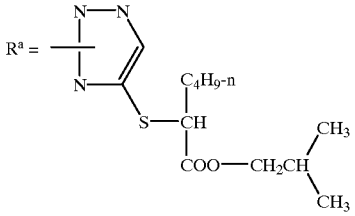
$R^b = OCH_3$ $R^c = NH—CO—C_{17}—H_{33}$-n
D-8
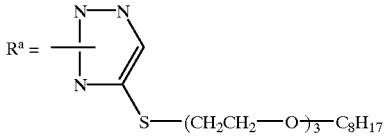
$R^b = —Cl$ $R^c = —COO—C_{16}H_{33}$-n
D-9
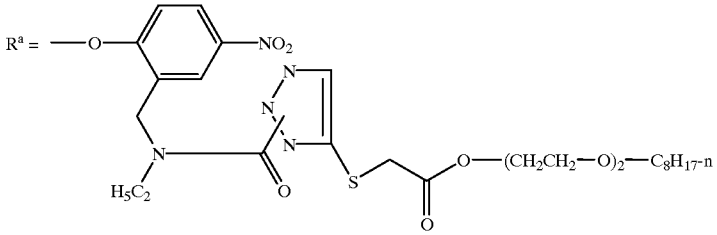
$R^b = —OC_{12}H_{25}$-n $R^c = —SO_2—NH—CO—C_2H_5$
D-10
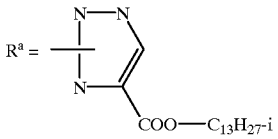
(Mixture of isomers and homologues)
$R^b = —Cl$ $R^c = —NH—CO—CH(C_6H_{13}\text{-n})—C_8H_{17}$-n
D-11
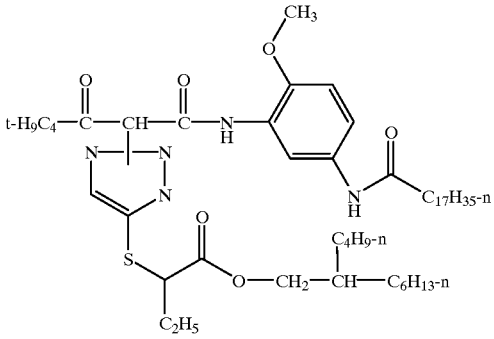
D-12
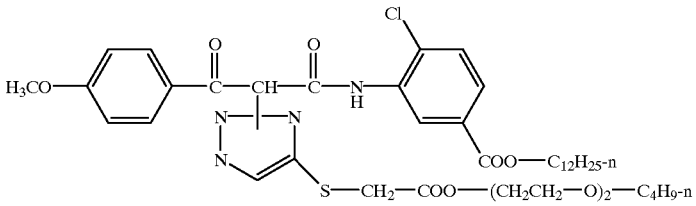

-continued
D-13
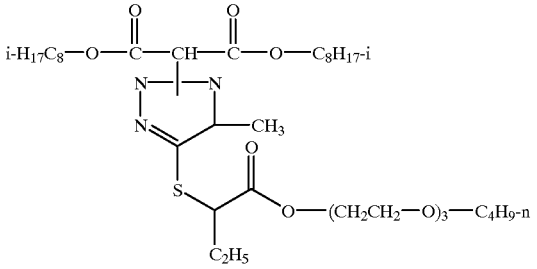
D-14
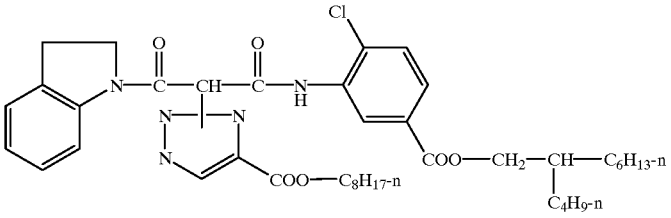
D-15
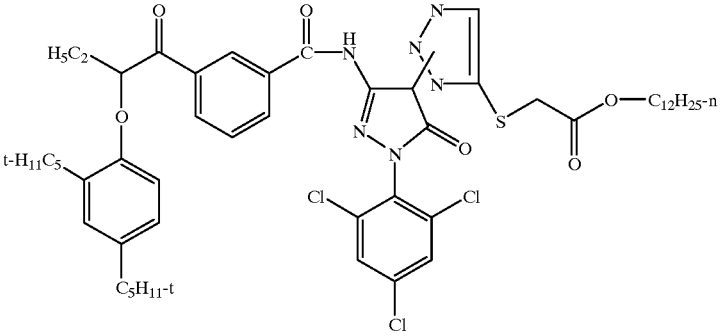
D-16
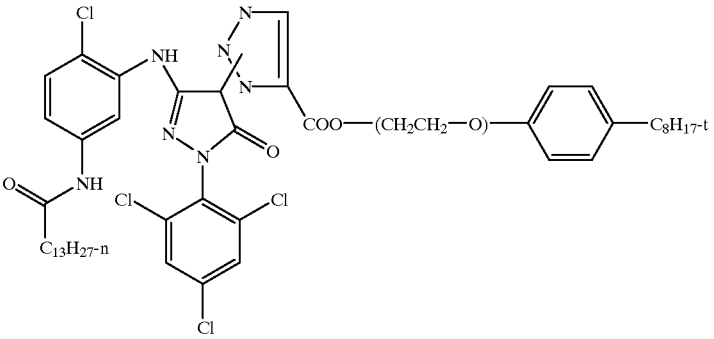
D-17
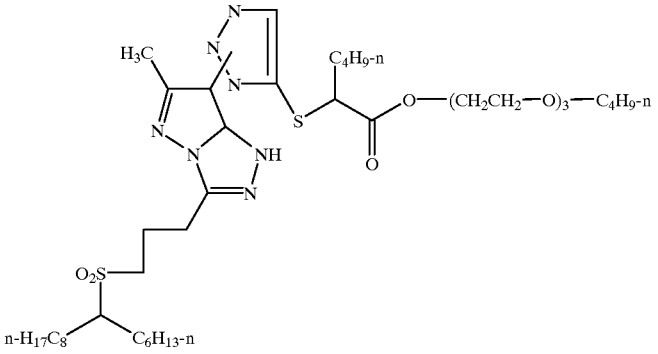

-continued
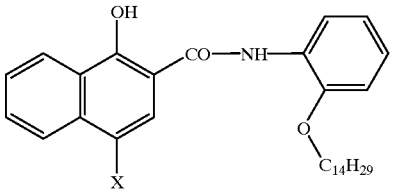
D-18
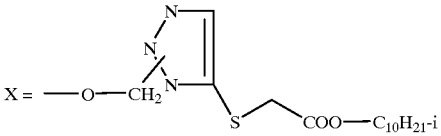
(Mixture of isomers)
D-19
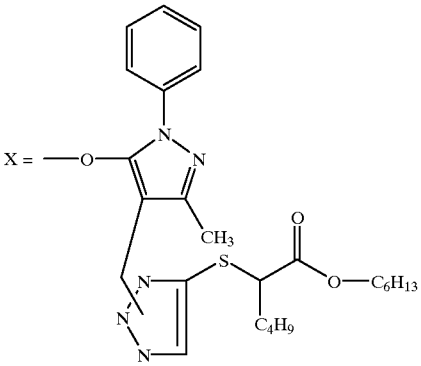
D-20
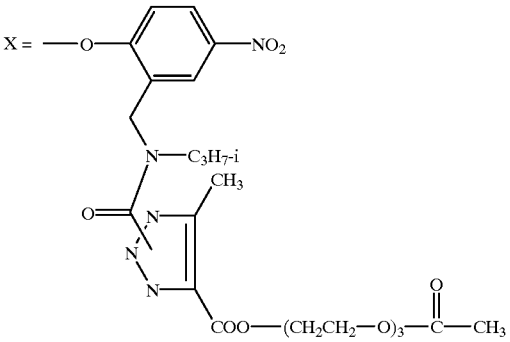
D-21
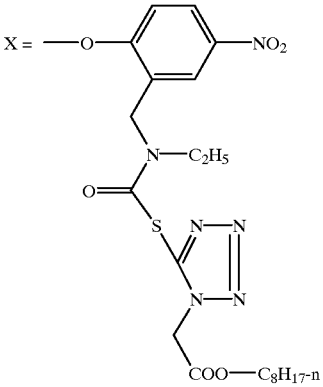
D-22
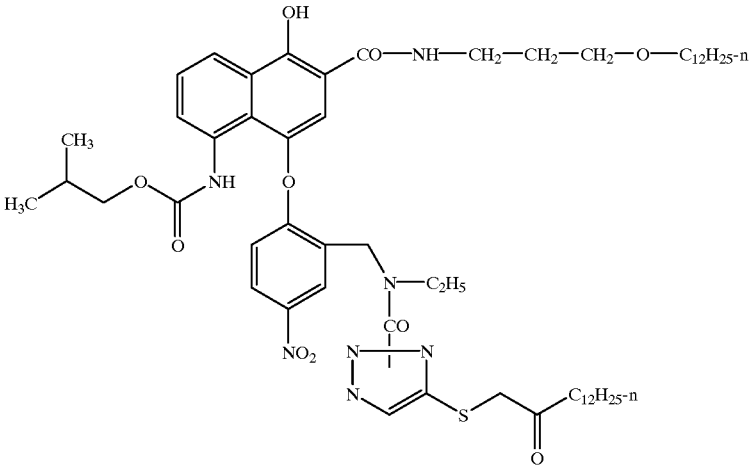

-continued

D-23

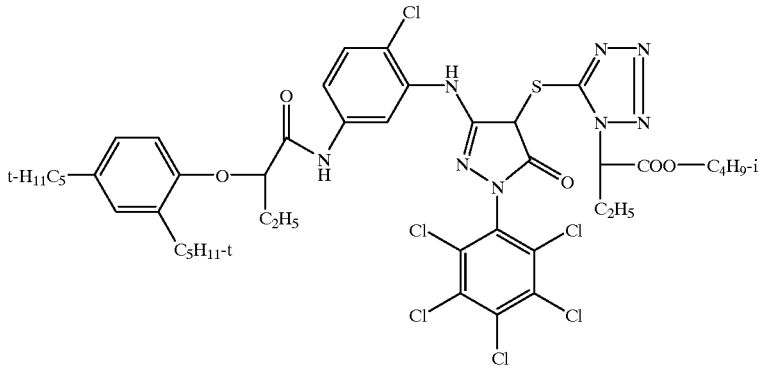

In a preferred embodiment of the invention, the oil former has a $pK_a$ value of 8 to 15.

In another preferred embodiment, the oil former complies with one of the formulae (O-I), (O-II) and/or (O-III), which may also comprise polymers.

$R^{11}$—COOH (O-I), $R^{21}$—NH—$SO_2$—$R^{22}$ (O-II), $R^{31}$—OH (O-III), wherein $R^{11}$, $R^{22}$ mean alkyl or substituted alkyl, alkenyl or substituted alkenyl, aryl or substituted aryl, heteroaryl or substituted heteroaryl, $R^{21}$ means H or $R^{22}$ and $R^{31}$ means substituted aryl or substituted heteroaryl and (O-I), (O-II) or (O-III) contain at least 8 C atoms per carboxyl, sulfonamide or phenolic hydroxy group.

In a particularly preferred embodiment, the oil former complies with one of the formulae (O-I), (O-II) and/or (O-III), wherein $R^{11}$, $R^{22}$ mean alkyl or substituted alkyl, alkenyl or substituted alkenyl, phenyl or substituted phenyl, $R^{21}$ means H or $R^{22}$ and $R^{31}$ means substituted phenyl.

In another particularly preferred embodiment, the oil former complies with the formula (O-I), wherein $R^{11}$ means alkyl or substituted alkyl, alkenyl or substituted alkenyl and (O-I) contains at least 10 C atoms per carboxyl group.

For the purposes of the present invention, alkyl and alkenyl residues may be linear, branched or cyclic. Alkyl, alkenyl and aryl groups may, for example, be substituted by alkyl, aryl, heterocyclyl, hydroxy, carboxy, halogen, alkoxy, aryloxy, heterocyclyloxy, alkylthio, arylthio, heterocyclylthio, acyl, acyloxy, acylamino, cyano, nitro or mercapto groups, wherein heterocyclyl denotes a saturated, unsaturated or aromatic heterocycle and acyl denotes the residue of an aliphatic, olefinic or aromatic carboxylic, carbamic, carbonic, sulfonic, amidosulfonic, phosphoric, phosphonic, phosphorous, phosphinic or sulfinic acid.

Examples of oil formers of the formulae (O-I), (O-II) and (O-III) are listed below.

O-I-1

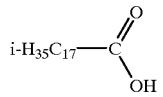

(mixtures of isomers/homologues)

O-I-2

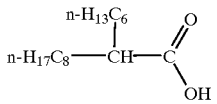

O-I-3

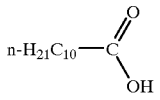

O-I-4

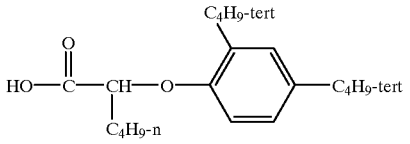

O-I-5

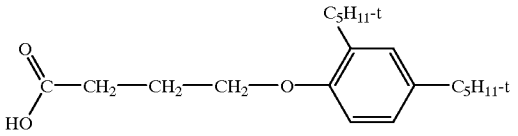

O-I-6

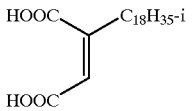

(mixture of isomers)

O-I-7

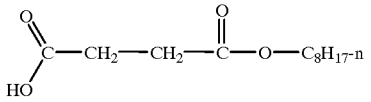

-continued
O-I-8
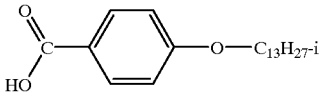
(mixture of isomers/homologues)
O-I-9
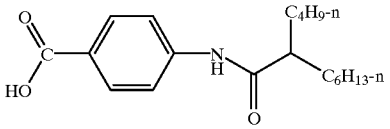
O-I-10
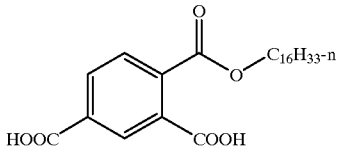
O-I-11
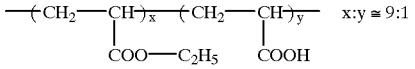
x:y ≅ 9:1
O-I-12
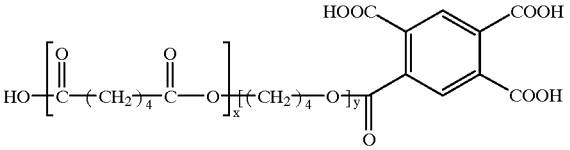
x:y ≅ 1:1
O-I-13
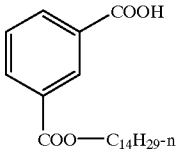
O-I-14
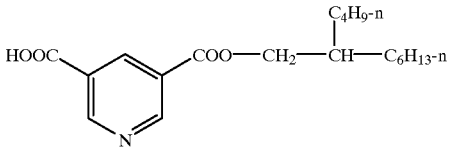
O-I-15
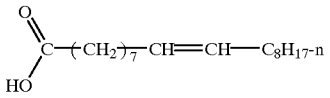
O-II-1
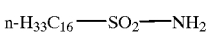
O-II-2
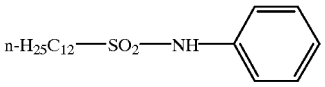
O-II-3
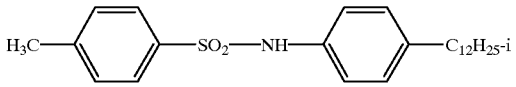
(mixture of isomers)
-continued
O-II-4
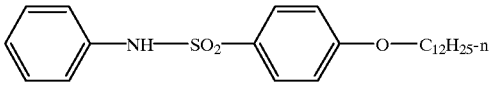
O-II-5
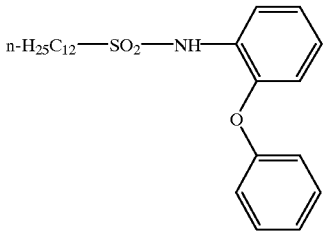
O-II-6
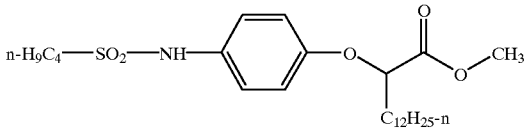
O-II-7
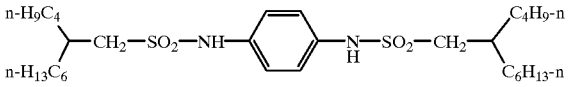
O-II-8
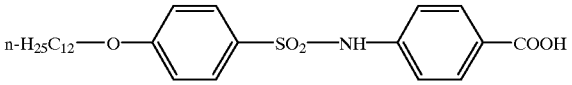
O-II-9
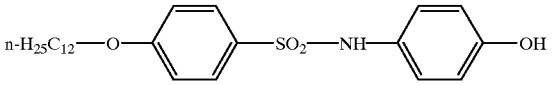
O-II-10
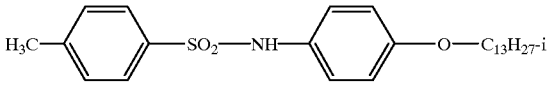
(mixture of isomers/homologues)
O-II-11
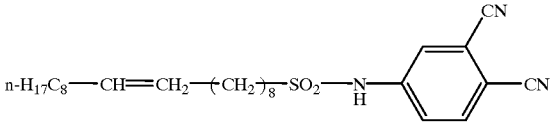
O-II-12
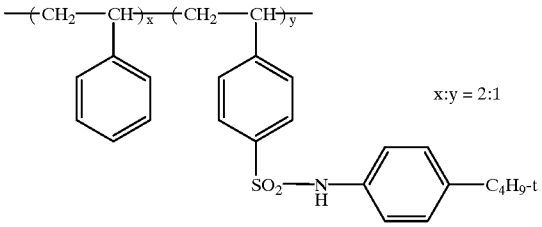
x:y = 2:1

-continued

O-II-13

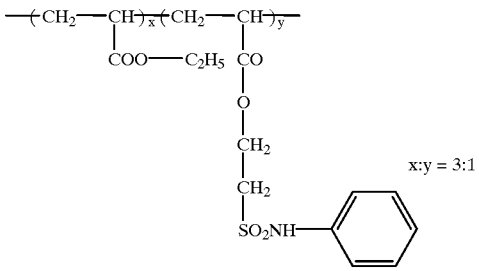

x:y = 3:1

O-III-1

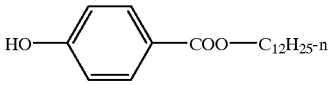

O-III-2

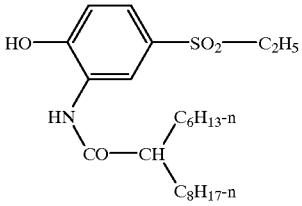

O-III-3

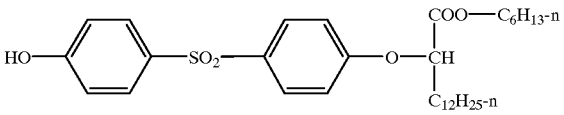

O-III-4

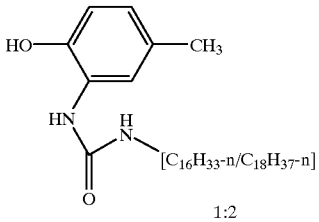

1:2

O-III-5

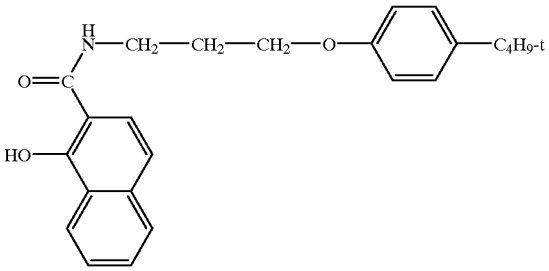

O-III-6

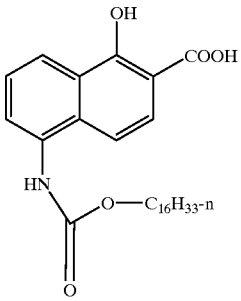

-continued

O-III-7

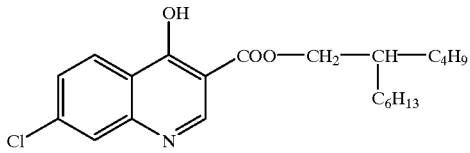

O-III-8

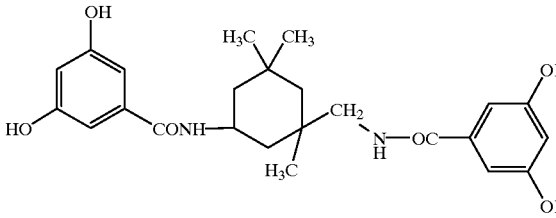

The oil formers, couplers and DIR couplers may be produced using methods known from the literature.

Within a layer of the photographic material, the weight ratio of oil former according to the invention to DIR coupler is 1:10 to 5000:1. If the same layer contains no further coupling compounds, this ratio is 1:10 to 10:1. The application rate for the DIR coupler is 1 to 50 mg per $m^2$ per layer of the photographic material.

In another preferred embodiment the spectrally sensitised silver halide emulsion layer contains the oil former and the magenta coupler in the form of an emulsion, wherein this emulsion may contain further additives, such as for example coupling compounds and/or other oil formers.

In another particularly preferred embodiment, the spectrally sensitised silver halide emulsion layer contains the oil former and the DIR coupler in the form of an emulsion, wherein this emulsion contains substantially no further additives.

Examples of colour photographic materials are colour negative films, colour reversal films, colour positive films, colour photographic paper, colour reversal photographic paper, colour-sensitive materials for the dye diffusion transfer process or the silver dye bleaching process. A review may be found in Research Disclosure 37038 (1995) and Research Disclosure 38957 (1996).

The photographic materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in J. Inf. Rec. Mats., 1994. volume 22, pages 183–193 and in Research Disclosure 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Photographic materials with camera sensitivity conventionally contain silver bromide-iodide emulsions, which may optionally contain small proportions of silver chloride. Photographic print materials contain either silver chloride-bromide emulsions containing up to 80 wt. % of AgBr or silver chloride-bromide emulsions containing above 95 mol % of AgCl.

Details of further colour couplers other than those according to the invention may be found in Research Disclosure 37254, part 4 (1995), page 288, in Research Disclosure 37038, part II (1995), page 80 and in Research Disclosure 38957, part X.B (1996), page 616. These compounds may occur in one or more layers of the photographic material and may also be used in a layer together with the compounds according to the invention. The maximum absorption of the dyes formed from the couplers and the developer oxidation product is preferably within the following ranges: yellow coupler 430 to 460 nm, magenta coupler 540 to 560 nm, cyan coupler 630 to 700 nm.

Details relating to further compounds other than the DIR compounds, in particular couplers, according to the invention may be found in Research Disclosure 37254, part 5 (1995), page 290, in Research Disclosure 37038, part XIV (1995), page 86 and in Research Disclosure 38957, part X.C (1996), page 618. These compounds may occur in one or more layers of the photographic material and may also be used in a layer together with the compounds according to the invention.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292. The methods of introduction also apply to the oil formers according to the invention.

The non-photosensitive interlayers generally arranged between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq..

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq..

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX; and XX (1996), paces 630 et seq. together with example materials.

EXAMPLE 1

Layer Structure 101

A colour photographic recording material for colour negative development was produced (layer structure 1A) by applying the following layers in the stated sequence onto a layer support of cellulose triacetate. Quantities are stated in each case per 1 $m^2$. The silver halide application rate is stated as the corresponding quantities of $AgNO_3$; the silver halides are stabilised with 0.5 g of 4-hydroxy-6-methyl-1, 3,3a,7-tetraazaindene per mol of $AgNO_3$.

1st layer (anti-halo layer)

| | | |
|---|---|---|
| 0.3 | g | of black colloidal silver |
| 1.2 | g | of gelatine |
| 0.3 | g | of UV absorber UV-1 |
| 0.06 | g | of UV absorber UV-2 |
| 0.2 | g | of DOP (developer oxidation product) scavenger SC-1 |
| 0.02 | g | of oil former, tricresyl phosphate (TCP) |

2nd layer (low-sensitivity red-sensitive layer)

| | | |
|---|---|---|
| 0.7 | g | of $AgNO_3$ of a spectrally red-sensitised AgBrI emulsion, 4 mol % iodide, average grain diameter 0.42 $\mu$m |

-continued 1 g of gelatine
0.35 g of colourless coupler C-1
0.05 g of coloured coupler RC-1
0.03 g of coloured coupler YC-1
0.36 g of oil former, TCP 3rd layer (medium-sensitivity red-sensitive layer)

0.8 g of $AgNO_3$ of a spectrally red-sensitised AgBrI emulsion, 5 mol % iodide, average grain diameter 0.53 μm
0.6 g of gelatine
0.15 g of colourless coupler C-2
0.03 g of coloured coupler RC-1
0.02 g of DIR coupler DK-1
0.18 g of oil former, TCP 4th layer (high-sensitivity red-sensitive layer)

1 g of $AgNO_3$ of a spectrally red-sensitised AgBrI emulsion, 6 mol % iodide, average grain diameter 0.85 μm
1 g of gelatine
0.1 g of colourless coupler C-2
0.005 g of DIR coupler DK-2
0.11 g of oil former, TCP 5th layer (interlayer)

0.8 g of gelatine
0.07 g of DOP scavenger SC-2
0.06 g of aurintricarboxylic acid aluminium salt 6th layer (low-sensitivity green-sensitive layer)

0.65 g of $AgNO_3$ of a spectrally green-sensitised AgBrI emulsion, 4 mol % iodide, average grain diameter 0.35 μm
0.8 g of gelatine
0.25 g of colourless coupler M-1
0.07 g of coloured coupler YM-1
0.035 g of DIR coupler DK-3
0.23 g of oil former, TCP 7th layer (medium-sensitivity green-sensitive layer)

0.95 g of $AgNO_3$ of a spectrally green-sensitised AgBrI emulsion, 4 mol % iodide, average grain diameter 0.50 μm
1.0 g of gelatine
0.20 g of colourless coupler M-1
0.05 g of coloured coupler YM-1
0.022 g of DLR coupler DK-3
0.17 g of oil former, TCP 8th layer (high-sensitivity green-sensitive layer)

0.8 g of $AgNO_3$ of a spectrally green-sensitised AgBrI emulsion, 6 mol % iodide, average grain diameter 0.70 μm -continued 1.2 g of gelatine
0.07 g of colourless coupler M-2
0.015 g of coloured coupler YM-2
0.0069 g of DIR coupler D-2
0.09 g of oil former, TCP 9th layer (yellow filter layer)

0.09 g of yellow dye GF-1
1 g of gelatine
0.08 g of DOP scavenger SC-2
0.26 g of oil former, TCP 10th layer (low-sensitivity blue-sensitive layer)

0.3 g of $AgNO_3$ of a spectrally blue-sensitised AgBrI emulsion, 6 mol % iodide, average grain diameter 0.44 μm
0.5 g of $AgNO_3$ of a spectrally blue-sensitised AgBrI emulsion, 6 mol % iodide, average grain diameter 0.50 μm
1.9 g of gelatine
1.1 g of colourless coupler Y-1
0.037 g of DIR coupler DK-4
0.6 g of oil former, TCP 11th layer (high-sensitivity blue-sensitive layer)

0.6 g of $AgNO_3$ of a spectrally blue-sensitised AgBrI emulsion, 7 mol % iodide, average grain diameter 0.95 μm
1.2 g of gelatine
0.1 g of colourless coupler Y-1
0.006 g of DLR coupler DK-5
0.11 g of oil former, TCP 12th layer (micrate layer)

0.1 g of $AgNO_3$ of a micrate AgBrI emulsion, 0.5 mol % iodide, average grain diameter 0.06 μm
1 g of gelatine
0.4 mg of $K_2[PdCl_4]$
0.4 g of UV absorber UV-1
0.08 g of UV absorber UV-2
0.3 g of oil former, TCP 13th layer (protective and hardening layer)

0.25 g of gelatine
0.75 g of hardener H-1

Once hardened, the overall layer structure had a swelling factor of ≦3.5.

Substances used in Example 1:

UV-1

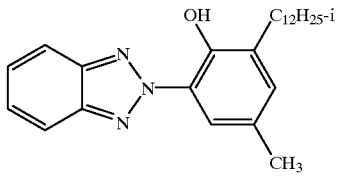

(mixture of isomers)

UV-2

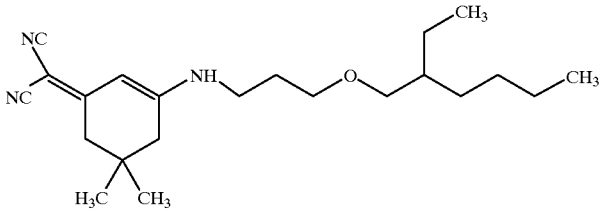

-continued
C-1
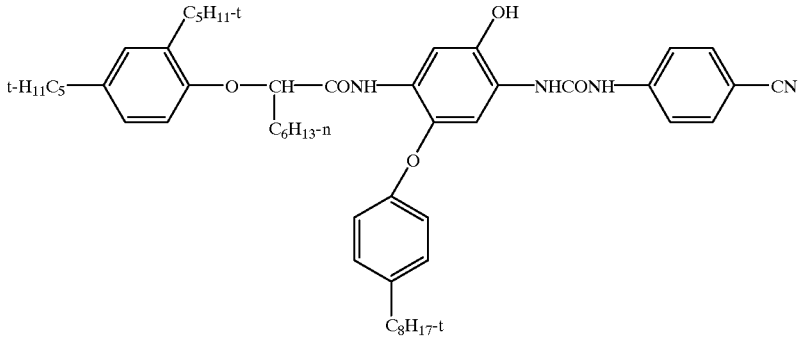
C-2
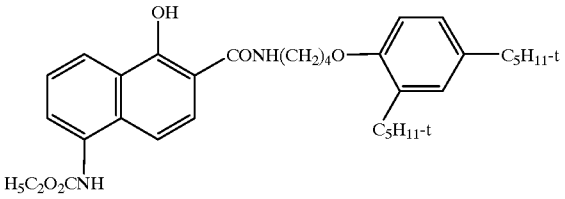
RC-1
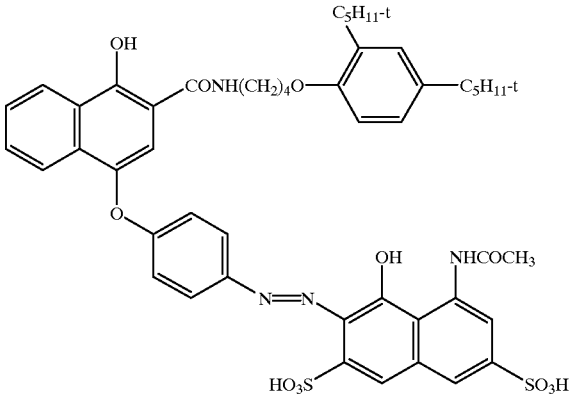
YC-1
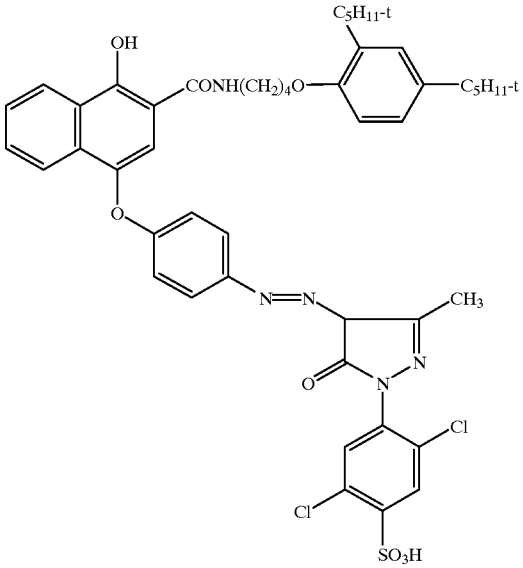

-continued
M-1
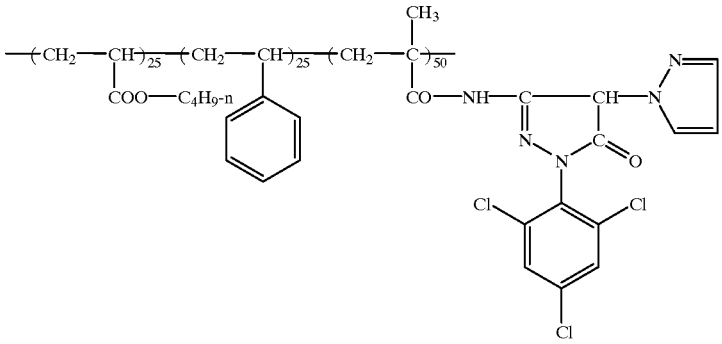
M-2
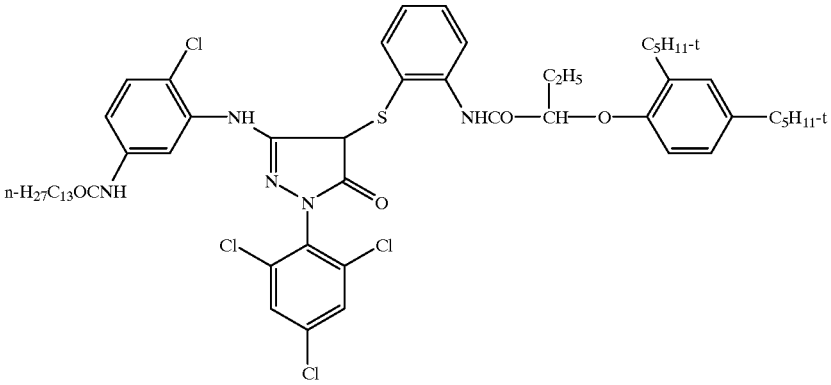
YM-1
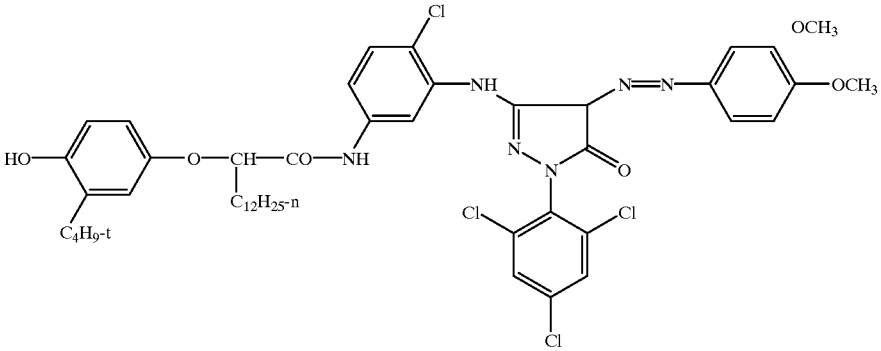
YM-2
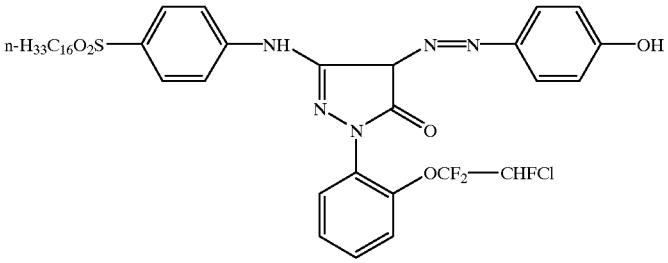

-continued
Y-1
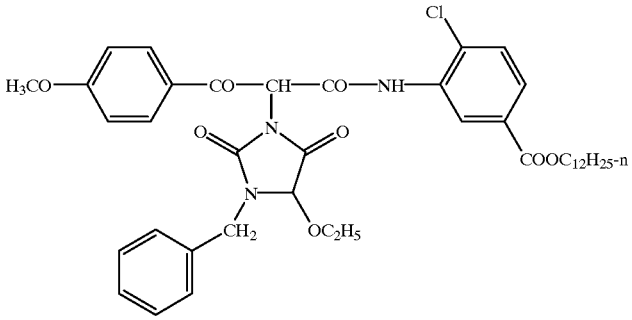
DK-1
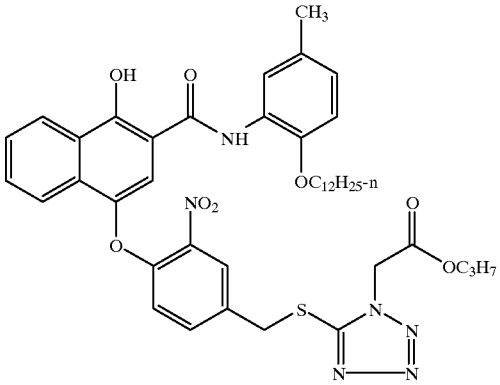
DK-2
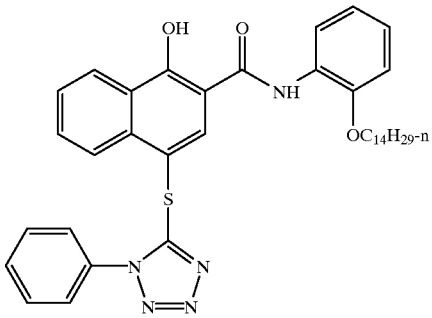
DK-3
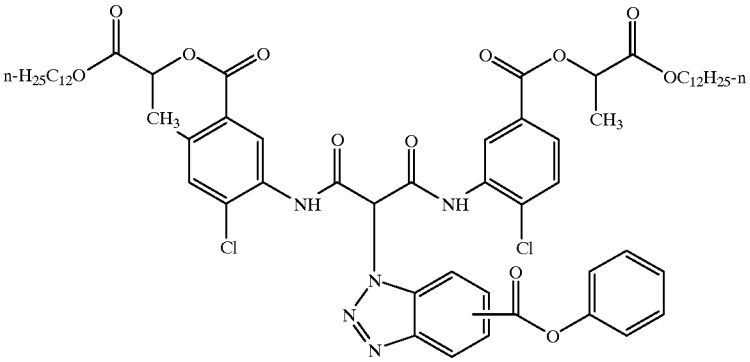

-continued

DK-4

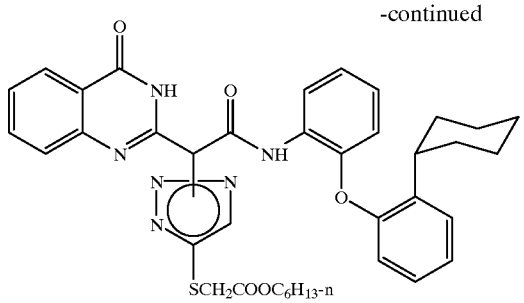

DK-5

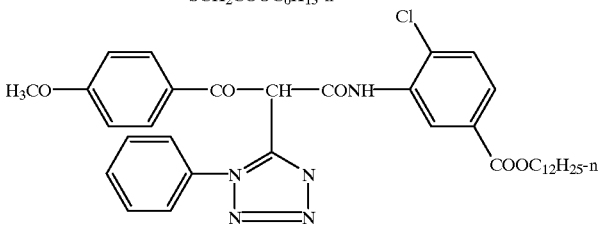

SC-1

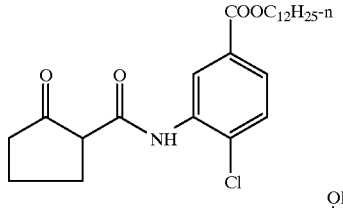

SC-2

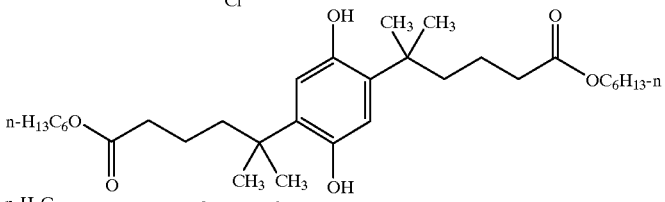

GF-1

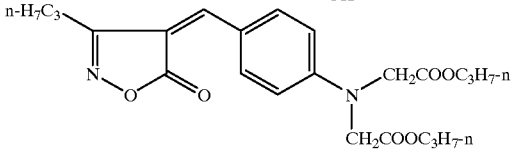

H-1

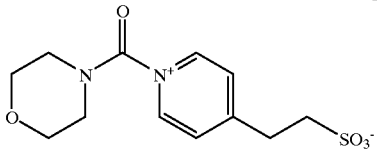

Sensitivity, gradation and interimage effect on green exposure are then determined ($E_{green}$, $\gamma_{green}$, $IIE_{green}$), wherein the following applies $$IIE_{green} = 100 \cdot \left( \frac{\gamma_{green}(\text{selective green exposure})}{\gamma_{green}(\text{white exposure})} - 1 \right) \%$$

The results are shown in Table 1.

Layer Structures 102 to 110

Layer structures 102 to 110 were produced in the same way as layer structure 101, except that the quantity of DIR coupler in layer 8 was varied such that all the layer structures have identical gradation, DIR coupler D-2 was optionally replaced by D-3 and the oil former TCP was replaced by that stated in Table 1.

V-1

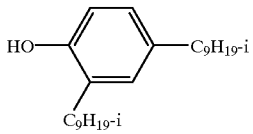

As Table 1 shows, using the oil formers according to the invention results in an increase in the IIE, without any significant reduction in sensitivity.

With TCP as the oil former, DIR coupler D-3 has no effect when used in a concentration of 5 to 20 mg/m$^2$m. The results, layer structure 106 being an example, are identical to those without use of a DIR coupler (layer structure 111).

| Layer structure | Layer 8 DIR coupler | Application rate of DIR coupler | Layer 8 Oil former | pKa of oil former | Sensitometry $E_{green}$ | $\gamma_{green}$ | $IIE_{green}$ | |
|---|---|---|---|---|---|---|---|---|
| 101 | D-2 | 6.9 mg/m$^2$ | TCP | >20 | 3.36 | 0.53 | 56% | Comparison |
| 102 | D-2 | 6.1 mg/m$^2$ | V-1 | 18.0 | 3.37 | 0.53 | 55% | Comparison |
| 103 | D-2 | 9.4 mg/m$^2$ | O-I-6 | 11.0 | 3.36 | 0.53 | 63% | Invention |
| 104 | D-2 | 8.4 mg/m$^2$ | O-I-2 | 12.0 | 3.35 | 0.53 | 65% | Invention |
| 105 | D-2 | 6.4 mg/m$^2$ | O-I-11 | 10.0 | 3.37 | 0.53 | 61% | Invention |
| 106 | D-3 | 10 mg/m$^2$ | TCP | >20 | 3.45 | 0.95 | 40% | Comparison |
| 107 | D-3 | 12.7 mg/m$^2$ | O-I-6 | 11.0 | 3.35 | 0.53 | 68% | Invention |
| 108 | D-3 | 8.0 mg/m$^2$ | O-I-2 | 12.0 | 3.35 | 0.53 | 68% | Invention |
| 109 | D-3 | 7.9 mg/m$^2$ | O-II-10 | 12.5 | 3.34 | 0.53 | 63% | Invention |
| 110 | D-3 | 7.1 mg/m$^2$ | O-III-5 | 12.5 | 3.36 | 0.53 | 65% | invention |
| 111 | — | — | — | — | 3.46 | 0.97 | 41% | Comparison |

What is claimed is:

1. A color photographic material which comprises a support and at least one spectrally sensitized silver halide emulsion layer, wherein said silver halide emulsion layer contains an oil former having a pKa value of less than 18 and a DIR coupler and the material contains at least one color coupler of the formula (K-I)

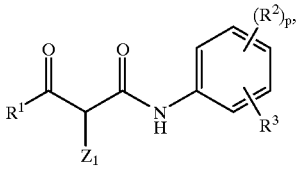

(K-II)

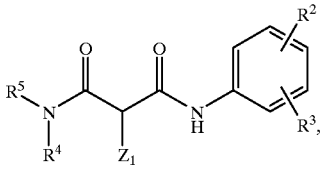

(K-III)

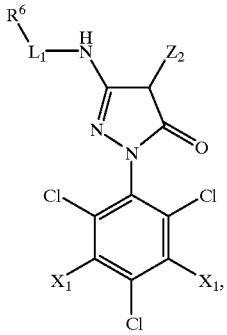

(K-IV)

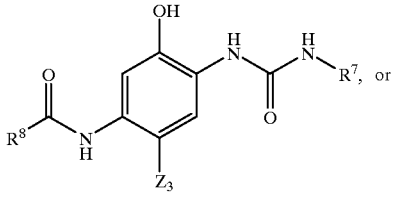

-continued (K-V)

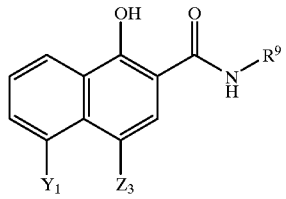

in which $R^1$, $R^6$ and $R^9$ are identical or different and are alkyl or aryl;

$R^2$ is chlorine or alkoxy;

$R^3$ is acyl or acylamino;

$R^4$, $R^5$ and $R^8$ are identical or different and are alkyl;

$R^7$ is aryl;

L, is a single bond or —CO—;

$Y^1$ is hydrogen or carbamoyloxy;

$X^1$ is hydrogen or chlorine;

$Z_1$ is a heterocyclic, nitrogenous, N-linked 5-membered ring;

$Z_2$ is hydrogen, alkylsulfido, arylsulfido or a heteroaromatic, nitrogenous, N-linked, 5-membered ring;

$Z_3$ is hydrogen, chlorine, alkoxy, aryloxy or alkylsulfido and n is 1 or 2, and wherein $R^4$ and $R^5$ optionally form a 5- or 6-membered ring, and wherein the oil former is of the formula $$R^{11}—COOH \qquad (O\text{-}I),$$

which optionally comprise polymers, wherein $R^{11}$ is alkyl, substituted alkyl, alkenyl, substituted alkenyl, aryl, substituted aryl, heteroaryl or substituted heteroaryl and (O-I) contains at least 8 C atoms per, carboxyl group.

2. The color photographic material according to claim 1, wherein the DIR coupler is of the formula (D-I)

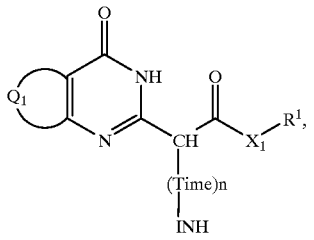

wherein

Q, is the remaining members to complete a fused and optionally substituted benzene or heteroaromatic ring;

is O or $NR^2$;

$R^1$ is alkyl, aryl, hetaryl or alkenyl;

$R^2$ is H or $R^1$;

INH is

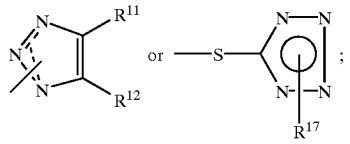

Time is a linking member which, on reaction of the coupler with the oxidation product of a silver halide developer, is released together with the residue INH attached thereto and in turn releases the residue INH with a delay under development conditions;

$R^{11}$ and $R^{12}$ are identical or different and are H, alkyl, aryl, alkaryl, —S—$R^{13}$, —COO—$R^{13}$, —CON($R^{13}$)$R^{14}$, —N($R^{15}$)$R^{16}$, —O$R^{13}$, or a heterocyclic group;

$R^{13}$ and $R^{14}$ are identical or different and are alkyl, aryl, alkenyl or alkynyl;

$R^{15}$ is H or $R^{13}$;

$R^{16}$ is acyl or $R^{13}$;

$R^{17}$ is H, alkyl, aryl or a heterocyclic group and n is 0 or 1, wherein at least one of the residues $R^{11}$ or $R^{12}$ is not H and $R^{11}$ and $R^{12}$, $R^{13}$ and $R^{14}$ or $R^{15}$ and $R^{16}$ optionally form a five- to seven-membered ring.

3. The color photographic material according to claim 1, wherein the spectrally sensitized silver halide emulsion layer contains the oil former and the DIR coupler in the form of an emulsion, wherein said emulsion comprises substantially no further additives.

4. The color photographic material according to claim 1, wherein the oil former has a $pK_a$ value of 8 to 15.

5. The color photographic material according to claim 1, wherein the coupler is of a formula (K-III).

6. The color photographic material according to claim 2, wherein INH is

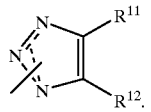

7. A color photographic material which comprises at least one spectrally sensitized silver halide emulsion layer wherein said silver halide emulsion layer contains an oil former having a pKa value of 8 to 18 and a DIR coupler which is of the formula $$A^1\text{-}(\text{Time})_n\text{-INH} \qquad \text{(D-II)}$$

wherein $A^1$ is of the formula (D-III)

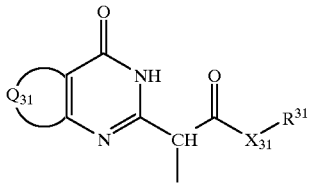

corresponds to the residue of a malonic acid diester, malonic ester amide yellow coupler, of a benzoylacetanilide or an acylacetamide yellow coupler, of an acylaminopyrazolone magenta coupler, of a pyrrolotriazole or pyrrolobenzimidazole magenta coupler, of a 2-acylamino-, 2,5-diacylamino- or 2-ureido-5-acylaminophenol cyano coupler or of a 2-acyl-5-acylaminonaphthol cyan coupler, which couples with the oxidation product of a silver halide developer under the conditions of photographic development and so releases the residue of the formula -(Time)$_n$-INH;

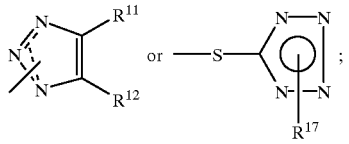

Time is a linking member which, on reaction of the coupler with the oxidation product of a silver halide developer, is released together with the residue INH attached thereto and in turn releases the residue INH with a delay under development conditions:

$R^{11}$ and $R^{12}$ are identical or different and are H, alkyl, aryl, alkaryl, —S—$R^{13}$, —COO—$R^{13}$, —CON($R^{13}$)$R^{14}$, —N($R^{15}$)$R^{16}$, —O$R^{13}$ or a heterocyclic group;

$R^{13}$ and $R^{14}$ are identical or different and are alkyl, aryl, alkenyl or alkynyl;

$R^{15}$ is H or $R^{13}$;

$R^{16}$ is acyl or $R^{13}$;

$R^{17}$ is H, alkyl, aryl or a heterocyclic group;

n is 0 or 1;

$Q_{31}$ is the remaining members to complete a fused and optionally substituted benzene or heteroaromatic ring;

$X_{31}$ is O or $NR^{32}$;

$R^{31}$ is alkyl, aryl, hetaryl or alkenyl and $R^{32}$ is H or $R^{31}$, and wherein at least one of the residues $R^{11}$ or $R^{12}$ is not H and $R^{11}$ and $R^{12}$, $R^{13}$ and $R^{14}$ or $R^{15}$ and $R^{16}$ optionally form a five- to seven-membered ring.

8. The color photographic material according to claim 7, wherein the oil former has a $pK_a$ value of 8 to 15.

9. The color photographic material according to claim 7, wherein the oil former is of the formula $R^{11}$—COOH (O-I), $R^{21}$—NH—$SO_2$—$R^{22}$ (O-II), or $R^{31}$—OH (O-III)

which optionally contain polymers, wherein $R^{11}$ and $R^{22}$ are identical or different and are alkyl, substituted alkyl, alkenyl, substituted alkenyl, aryl, substituted aryl, heteroaryl or substituted heteroaryl, $R^{21}$ is H or $R^{22}$ and $R^{31}$ is substituted aryl or substituted heteroaryl, and (O-I), (O-II) or (O-III) contain at least 8 C atoms per carboxyl, sulfonamide or phenolic hydroxy group.

10. The color photographic material according to claim 7, wherein the spectrally sensitized silver halide emulsion layer contains the oil former and the DIR coupler in the form of an emulsion, wherein this emulsion comprises substantially no further additives.

* * * * *

UNITED STATES PATENT AND TRADEMARK OFFICE

CERTIFICATE OF CORRECTION

PATENT NO. : 6,379,879 B2
DATED : April 30, 2002
INVENTOR(S) : Hagemann et al.

It is certified that error appears in the above-identified patent and that said Letters Patent is hereby corrected as shown below:

Column 40,
Lines 53, delete “n” and insert -- p --.

Signed and Sealed this

Tenth Day of September, 2002

*Attest:*

*Attesting Officer*

JAMES E. ROGAN
*Director of the United States Patent and Trademark Office*